US005941032A

United States Patent [19]

Lydon, Jr.

[11] Patent Number: 5,941,032

[45] Date of Patent: Aug. 24, 1999

[54] FRAMING ASSEMBLY FOR A DOOR LIGHT

[76] Inventor: William John Lydon, Jr., 250 Tar Hill Rd., Dyersburg, Tenn. 38024

[21] Appl. No.: 08/852,318

[22] Filed: May 7, 1997

[51] Int. Cl.[6] ..... E06B 1/04

[52] U.S. Cl. ..... 52/204.1; 52/455; 52/656.2; 52/656.4

[58] Field of Search ..... 52/455, 204.1, 52/656.2, 656.4

[56] References Cited

U.S. PATENT DOCUMENTS

| | | | |
|---|---|---|---|
| 836,885 | 11/1906 | Malmberg . | |
| 964,676 | 7/1910 | Nellis . | |
| 1,082,071 | 12/1913 | Danielson . | |
| 1,171,444 | 2/1916 | Larson et al. | 52/455 X |
| 1,270,014 | 6/1918 | Conwell . | |
| 3,004,641 | 10/1961 | Johnson | 52/455 |
| 3,487,602 | 1/1970 | Braun et al. | 52/455 |
| 3,750,358 | 8/1973 | Lewkowitz . | |
| 3,760,543 | 9/1973 | McAllister . | |
| 4,241,556 | 12/1980 | Bursk . | |
| 4,897,975 | 2/1990 | Artwick et al. . | |
| 4,947,597 | 8/1990 | Simpson . | |
| 5,018,330 | 5/1991 | Lewkowitz | 52/455 |
| 5,323,579 | 6/1994 | Ruff . | |
| 5,367,770 | 11/1994 | McCaughey . | |

*Primary Examiner*—Christopher Kent
*Attorney, Agent, or Firm*—Garrison, Morris & Haight

[57] ABSTRACT

A framing assembly for a door light which includes a first frame, a second frame, and a plurality of channel sections. The first and second frames are formed from a plurality of frame sections. The channel sections are disposed within the hollow space defined by the two skins of a door panel. The first frame sections are attached to the channel sections by any conventional fastening means. The first frame sections are provided with integral latch members and the second frames are provided with integral clip members which cooperate to retain the second frame member within the opening in a hollow door panel without the use of any visible external hardware. The framing assembly of the present invention may be provided with pre-finished surfaces and can be installed in pre-existing doors without the need for special welding equipment or extensive modification to the door panel prior to installation.

15 Claims, 14 Drawing Sheets

FRAMING ASSEMBLY FOR A DOOR LIGHT

FIELD OF THE INVENTION

The present invention relates generally to the field of frames for openings and more specifically to a framing assembly for a window in a door.

BACKGROUND OF THE INVENTION

A door light is a window which is installed in an opening in a door to allow additional light to enter a room and to enhance the appearance of the door. In a typical door light, a pane of glass is sandwiched between frames attached to both sides of a hollow door.

Many known door lights have frames which extend beyond the outer surfaces of the door. However, if low profile panic hardware must be installed in order to comply with fire codes or other safety regulations, often the panic hardware or the surface of the door must be shimmed or modified to allow the panic hardware to be installed over the protruding frame. Moreover, full length door lights which have frames that extend beyond the outermost surfaces of the door may not comply with handicap codes because the frame may catch on the wheel of a wheel chair or other equipment.

In addition, many existing door lights have frames that cannot be installed without welding or other methods which adversely affect pre-finished surfaces, such as polished brass. Typically, pre-finished frames must be welded prior to applying the finish. This process is time and labor intensive and results in less flexibility to the consumer to customize the size and shape of the frame while increasing cost to tho consumer. Frames having finished surfaces which are designed for installation in a pre-existing door must be fabricated and finished at the frame factory prior to shipment. Although special welding machines are available for welding pre-finished surfaces without affecting the final appearance of the surface, the specialized welding machines are expensive and not readily available for installing window lights outside of a factory. Therefore, if the window frame does not fit the opening in a door, the frame cannot be re-welded at the installation site without ruining the appearance of the pre-finished surface.

Further, although some existing door lights can be installed so that the outer surface of the frames are flush with the outer surface of the skins, extensive preparation to bend or modify the skins of the door is required before the frame can be installed.

In view of the foregoing, there is a need for a framing assembly that can be installed so that the outer surface of the frame does not extend past the surface of the door without modifying or bending the door skins prior to installation. Further, a need exists for a framing assembly that can be fabricated economically from components having pre-finished surfaces such as polished or antiqued brass, stainless steel, chrome or similar materials.

SUMMARY OF THE INVENTION

The present invention overcomes these and other disadvantages of existing door lights by providing a framing assembly which does not extend past the outer surfaces of the door. Further, the framing assembly of the present invention can be installed in a door without any significant modification to the skins of a door prior to installation. Moreover, the present framing assembly can be fabricated with prefinished surfaces such as polished brass, since the exposed surfaces of the frames of the present framing assembly require no welding.

The present framing assembly typically is installed in a door which has a front skin and a back skin. Each of the front and back skins has an interior surface and an exterior surface. The front skin is spaced apart from the the back skin to define a hollow space between the interior surface of each skin. An opening is cut through each of the front and back skins. When referring to the opening, the terms front and back are arbitrarily assigned for purposes of clarity in the summary and the detailed description. However, the front and back openings arc typically identical.

The framing assembly of the present invention preferably includes a first frame, a second frame and a plurality of channel sections for securing the first and second frames to the door. The channel sections are recessed between the interior surfaces of the front skin and the back skin. In a preferred embodiment, at least a first frame is secured directly to the channel sections. A second frame may be secured to either the first frame or the channel section. The first and second frames surround the perimeter of the openings in the front and back skins. The outer surface of the first and second frames are flush with the front and back outer surfaces of the door after the frames are installed within the openings in the door.

Each channel section includes a web member and two flange members. The web member of each channel section is an elongated and substantially rectangular member having two long edges and two short edges. In a preferred embodiment, the flange members also are elongated substantially rectangular members having two long edges and two short edges. One long edge of each flange member is attached to or depends from one of each of the long edges of the web member to form a channel section having a U-shaped cross-section. The web member defines one or more guide grooves for receiving screws or other fastening means for fastening at least one frame to the channel section. Although each channel section includes at least a web member and two flange members, preferably each channel section is formed from a single sheet of metal or other suitable material.

The channel sections are inserted in the hollow space around the openings in the door. The channel sections are of a width sufficient to allow the flanges to contact the interior surface of each skin of the door. Each channel section is oriented within the hollow space so that the flanges extend into the hollow space away from the openings. The channel sections are secured to the skins around the openings by welding the channel to the interior surfaces of the skins of the door. Preferably, the channel sections are completely recessed within the hollow space so that the web members do not extend beyond the periphery of the openings.

The first frame of the present frame assembly is formed from a plurality of frame sections. Each first frame section includes a first leg, a second leg, an inclined member and a stop member. The first leg has a first long edge and a second long edge. A plurality of holes for receiving screws or other fastening means is positioned between the first and second long edges of the first leg. The second leg, inclined member and stop member each have first and second long edges and first and second short edges. A first long edge of the second leg is joined to a first long edge of the first leg to form a first frame section having a generally L-shaped cross-section.

A first long edge of the inclined member is joined to a second long edge of the second leg. The inclined member extends at an angle toward the center line of the web member so that the inclined member is positioned directly above and spaced apart from the first leg. A first long edge of the stop member is joined to the second long edge of the inclined member. Preferably, the stop member extends from the inclined member toward the first leg in a direction which is substantially perpendicular to the first leg. In a particularly preferred embodiment, the second long edge of the first leg of the first frame is configured to form a latch member for retaining a clip member which is formed from a long edge of the first leg of the second frame.

The first frame sections are secured to the channel sections around the front opening by positioning the first leg on the web member. The holes in the first leg are aligned with the guide groove in the web member so that the first frame section can be securely attached to the web member of the channel section by inserting self-tapping screws through the aligned holes or by any other sutiable fastening means. The second leg of the first frame section is positioned along the periphery of the front opening but does not extend beyond the front door skin.

Preferably, the latch member is formed from the first leg of the first frame by folding a portion of the first leg along a line parallel to the second long edge of the first frame to form a down-turned segment which projects toward the web member of the channel section. The second long edge of the first leg is positioned above the web member to form narrow space or slot for receiving a clip member from the first long edge of the first leg of the second frame section. The inclined members and the second legs of the first frame sections cooperate to form the visible portion of the first frame. The stop members of the first frame sections cooperate to form a glass retaining surface.

The second frame is assembled from a plurality of sections. Each second frame section is formed from a first leg, a second leg, an inclined member and a stop member. Each first leg, second leg, inclined member and stop member of the second frame have first and second long edges and first and second short edges. A first long edge of the second leg is joined to the second long edge of the first leg along two long edges to form a first frame section having a generally L-shaped cross-section. A first long edge of the inclined member is joined to the second long edge of the second leg. The inclined member extends at an angle toward the centerline of the web member so that the inclined member is positioned directly above and spaced apart from the first leg. A first long edge of the stop member is joined to the second long edge of the inclined member. Preferably, the stop member extends from the inclined member in a direction which is substantially perpendicular to the first leg. A plurality of holes for receiving screws or other fastening means may be disposed in the inclined member. In a preferred embodiment, the inclined member does not include holes for receiving screws or fastening means. Rather, the fastening means includes a clip member formed at the second long edge of the first leg. The clip member cooperates with the latch member formed with the first frame section to fasten the second frame sections into position without the need for screws.

The second frame sections are positioned on the channel sections around the back opening so that the first leg of the second frame section rests on the web member of the channel. The second leg is positioned along the periphery of the back opening but does not extend beyond the back door skin. The clip member formed at the second long edge of the first leg snaps in the narrow space formed between the down-turned segment of the latch member and the web member. The clip member typically is larger than the narrow space so that the clip member cannot be easily removed once inserted between the web member and the down-turned segment of the first frame section. The fold in the first leg of the first frame section forms a bend that rests against the second leg of the second frame section. The bend cooperates with the clip member and the latch member to prevent movement of the second frame section so that the second frame section is securely fastened in the back opening. The inclined members and the second legs of the second frame sections cooperate to form the visible portion of the second frame. The stop members of the second frame sections cooperate to form a glass retaining surface. The glass retaining surfaces of the first and second frames cooperate to hold a pane of glass securely within the opening.

The ends of each first and second frame sections have a miter or similar configuration so that adjoining frame sections fit together in an attractive manner. The visible portions of the first and second frames of the present door light require no welding to install the framing assembly of the present invention. Therefore, particularly preferred materials for the first and second frame include stainless steel, polished or antiqued brass, or similar metals that can support a pre-finished surface.

Preferably, the channel sections, first frame sections and second frame sections are each provided in eight to twelve foot lengths. The sections typically are fabricated in a range of widths to accommodate a variety of door sizes.

BRIEF DESCRIPTION OF THE DRAWINGS

The foregoing aspects and other features of the present invention are explained in the following specification taken in connection with the accompanying drawings wherein.

DETAILED DESCRIPTION OF THE INVENTION

Figure 1A:
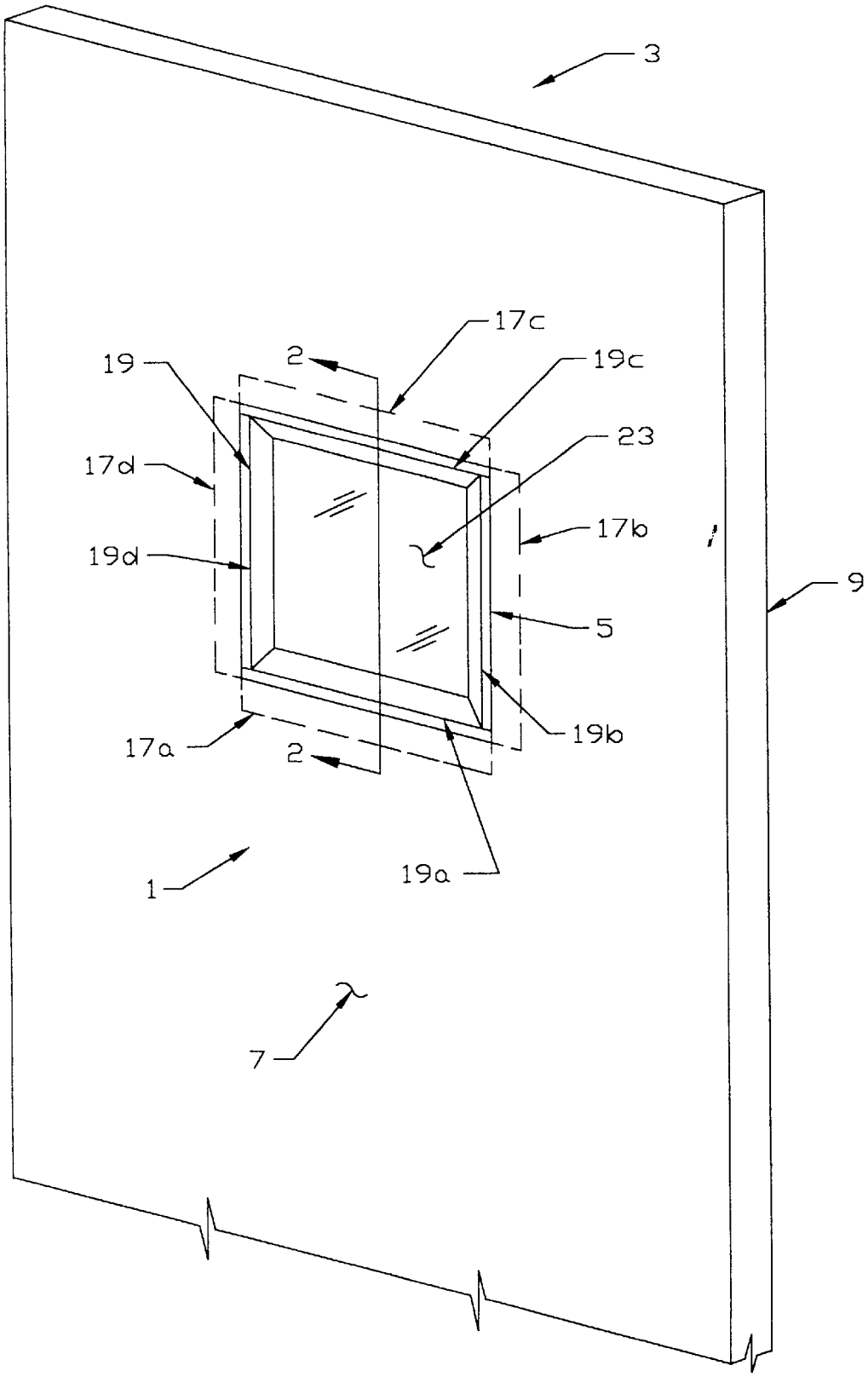
FIG. 1*a* is a perspective view showing features of the framing assembly of the present invention.
Figure 1B:
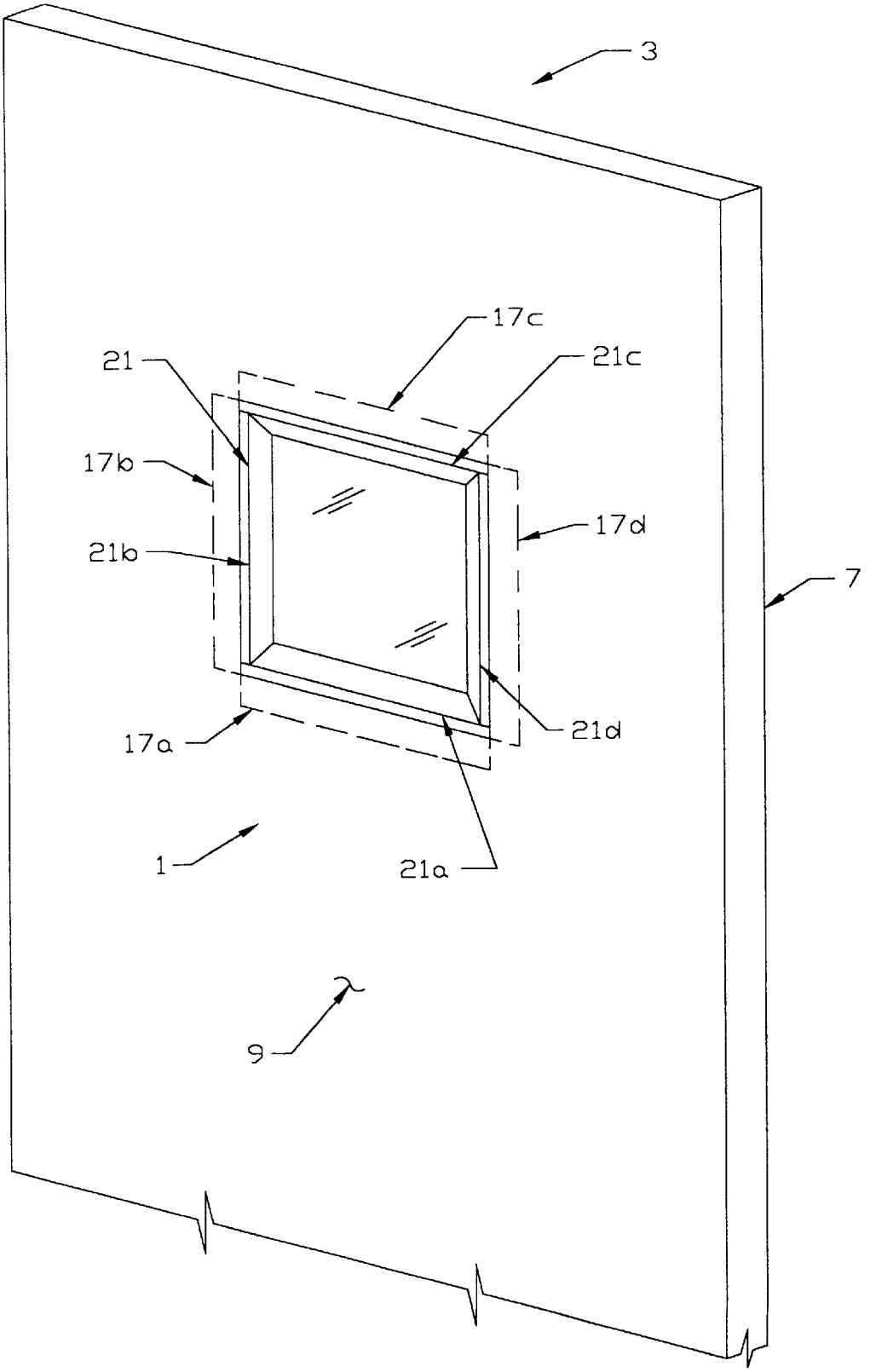
FIG. 1*b* is a perspective view showing features of the framing assembly of the present invention.
Figure 2:
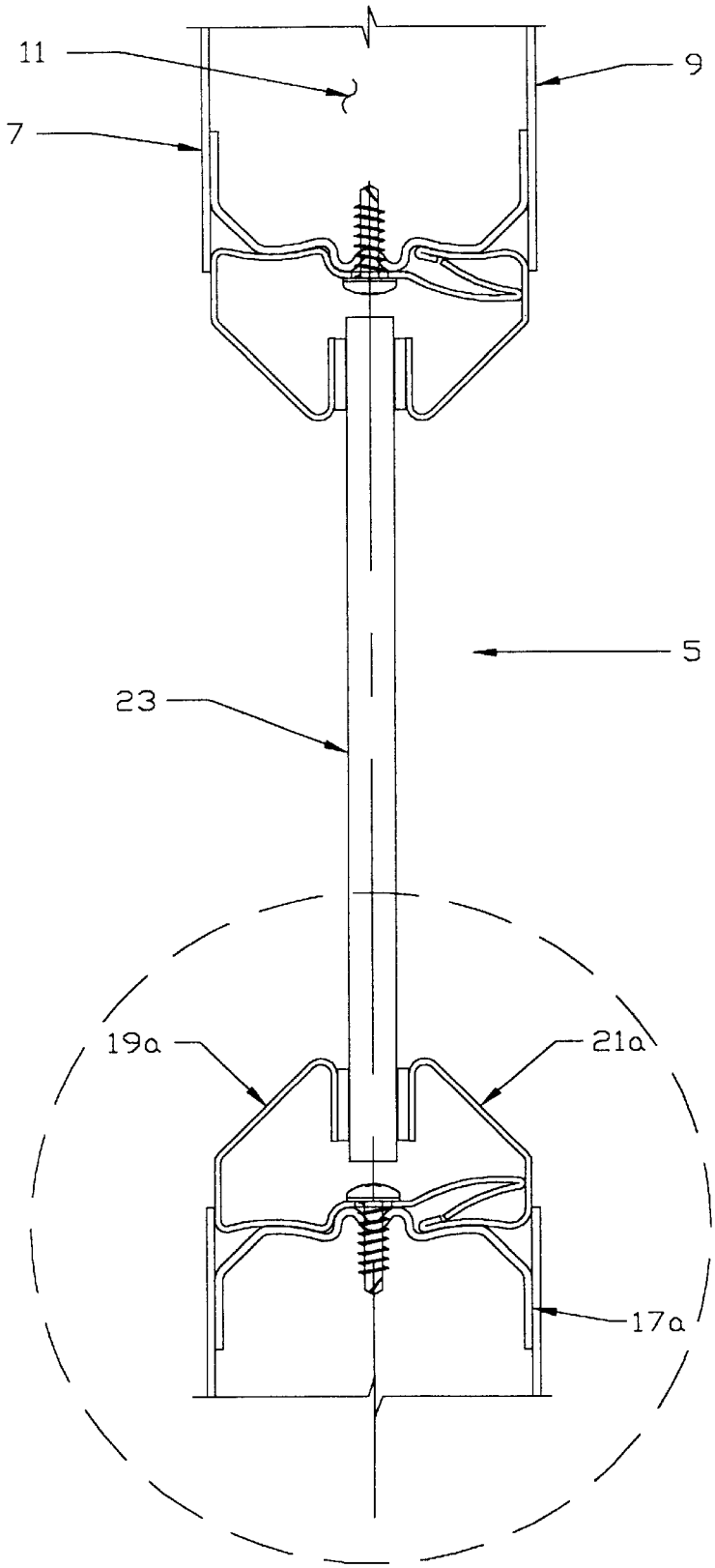
FIG. 2 is a cross-sectional view of the framing assembly shown in FIG. 1 taken along line 2—2.
Figure 3:
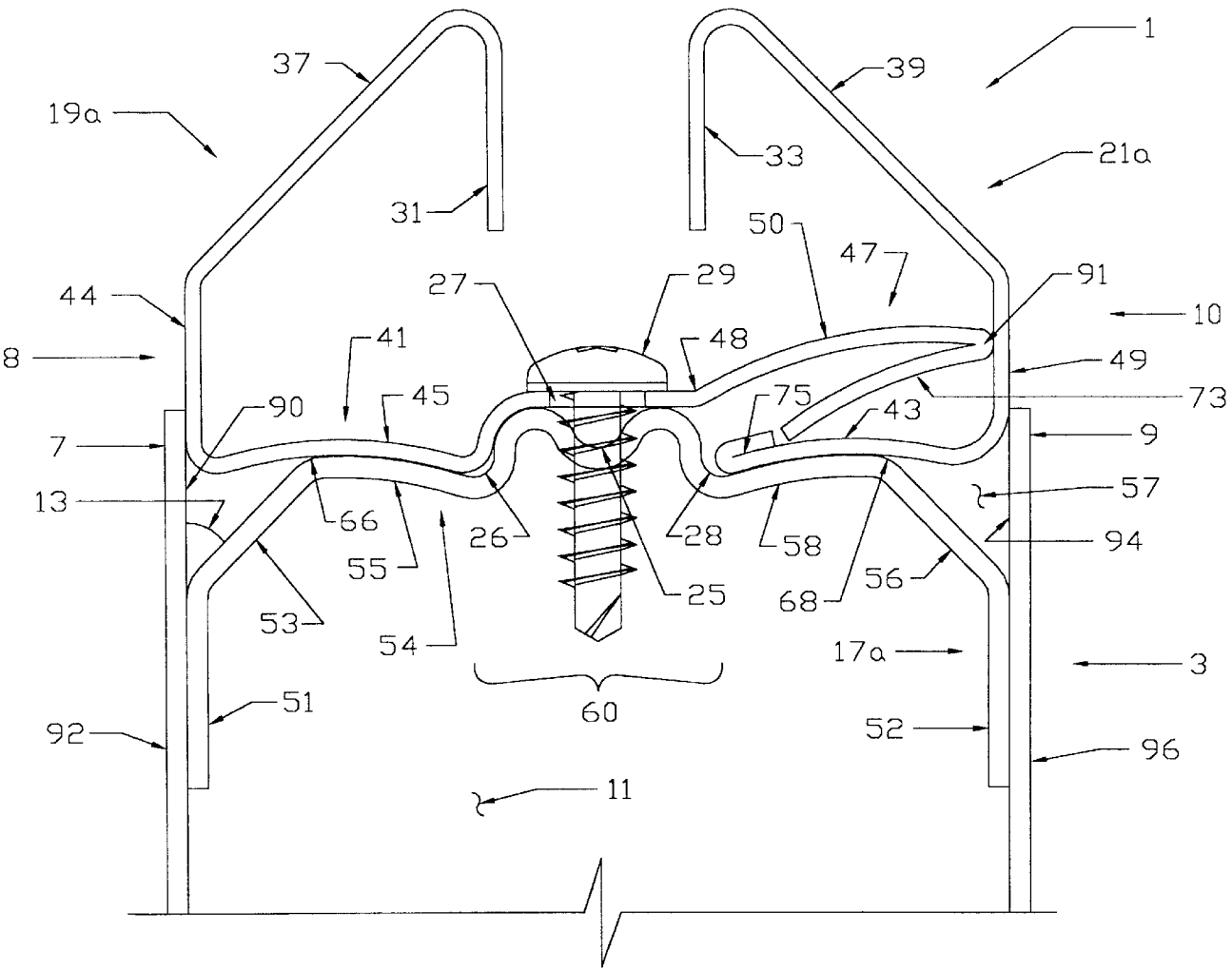
FIG. 3 is an enlarged view of a portion of the framing assembly shown in FIG. 2.

Referring now to FIGS. 1–3, the framing assembly of the present invention is designated generally as 1. The framing assembly 1 is installed in a door 3 having a front skin 7 spaced apart from a back skin 9. The front skin 7 has an interior surface 90 and an exterior surface 92. The back skin 9 has an interior surface 94 and an exterior surface 96. A hollow space 11 is defined between the interior surfaces 90 and 94 of the skins 7 and 9. A front opening 8 and a corresponding back opening 10 are cut in the front and back skins 7 and 9. The front opening 8 and back opening 10 typically define square or rectangular perimeters.

The present framing assembly 1 includes a first frame 19 and a second frame 21, and channel sections 17*a*, 17*b*, 17*c*, and 17*d* for securing the first 19 and second 21 frames to the door. The channel sections 17*a*, 17*b*, 17*c*, and 17*d* are recessed between the interior surfaces 90 and 94 of the front 7 and back 9 skins. The first frame 19 includes a plurality of sections 19*a*, 19*b*, 19*c*, and 19*d* that surround the perimeter of the front opening 8. Self-tapping screws 29 or other fastening means fasten the first frame sections to the channel sections. The second frame 21 includes a plurality of sections 21*a*, 21*b*, 21*c*, and 21*d* that surround the perimeter of the back opening 10. Self-tapping screws 29 or other fastening means fasten the second frame sections directly to the channel sections. Preferably, the sections of second frame 21 are secured around the back opening 10 by clip members 75 formed with the second frame sections as described in more detail below.

The detailed description and cross-sectional views depicting features of the channel section 17*a*, are typical for the remaining sections 17*b*, 17*c*, and 17*d*. Likewise, the detailed description and cross-sectional views depicting features of the first frame section 19*a* and second frame section 21*a* are typical for the remaining sections 19*b*, 19*c*, 19*d* and 21*b*, 21*c*, 21*d*.

Figure 4:
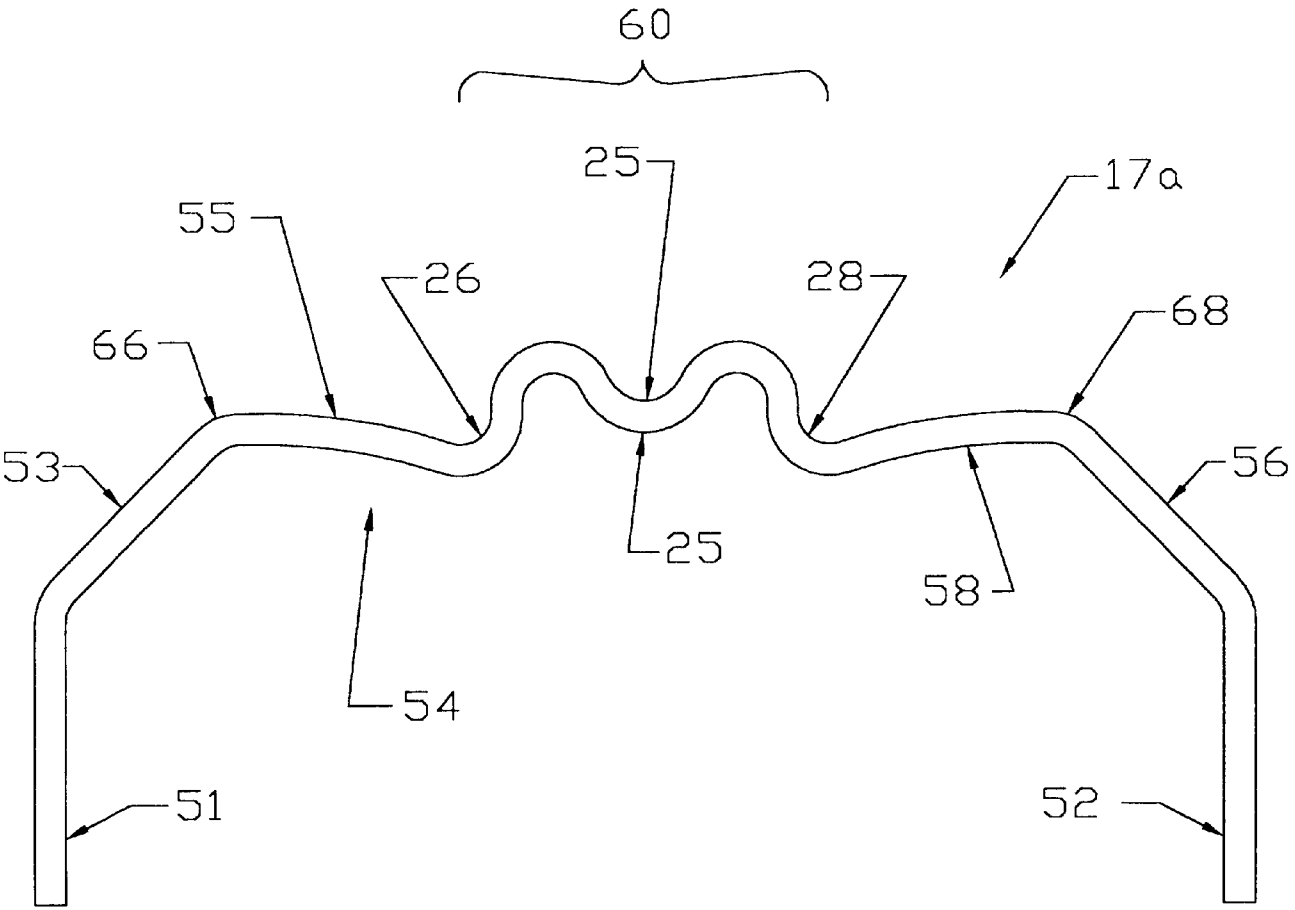
FIG. 4 is a cross-sectional view showing features of a preferred embodiment of the channel sections of the present invention.

As shown in FIGS. 3 and 4, channel section 17*a* includes a web member 54 and two flange members 51 and 52. The web member 54 is an elongated and substantially rectangular member having two long edges 66 and 68 and two short edges (not designated). In a preferred embodiment, the flange members 51 and 52 also are elongated and substantially rectangular members having two long edges 81 and 83 and two short edges (not designated). One long edge 83 of each flange member is attached to and depends from one of each of the long edges 66 and 68 of the web member 54 to form a channel section 17*a* having U-shaped cross-section. Preferably, flanges 51 and 52 include bevels 53 and 56 at the edges 66 and 68 of the web member 54.

The web member 54 includes a center portion 60 and curved segments 55 and 58 disposed on either side of the center portion 60. The center portion 60 defines three guide grooves 25, 26, 28 for receiving self-tapping screws or other fastening means. The guide grooves 25, 26. and 28 are preferably arcuate in shape so that self-tapping screws 29 can be easily threaded through the web member 54. The guide grooves 25, 26, 28 extend parallel to the flanges 51 and 52 along the length of the web member 54. Alternately, the guide grooves may be replaced by pre-drilled holes to receive fastening means such as rivets or bolts.

Figure 7:
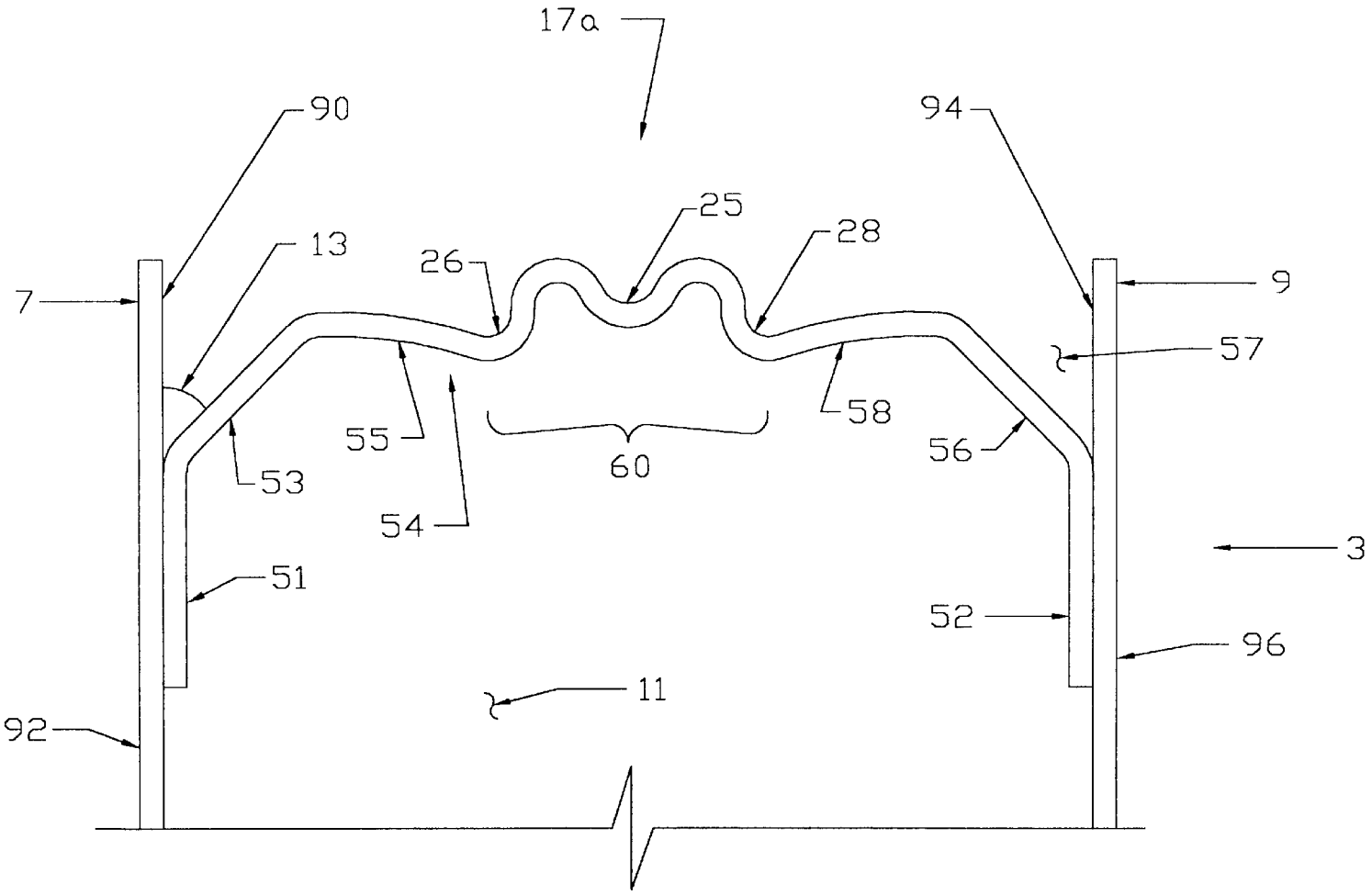
FIG. 7 is a cross-sectional view showing channel sections of the present invention installed between the skins of a door.

Referring to FIG. 7, the channel section 17*a* is inserted in the hollow space 11 between the skins 7 and 9. Preferably, the channel section 17*a* spans the distance between the front opening 8 and the back opening 10 so that the channel section 17*a* is positioned along one side of the perimeter of both the front opening 8 and the back opening 10. The flanges 51 and 52 contact the interior surfaces 90 and 94 of the door skins 7 and 9 and extend away from the openings into the hollow space 11. Preferably, the web member 54 of channel section 17*a* is completely recessed in the hollow space 11 so that the web member 54 does not extend past the perimeter of the front 8 or the back 10 openings.

Tack welds 13 secure the channel section 17*a* to the interior surfaces 90 and 94 of the door skins 7 and 9. When the optional bevels 53 and 56 are included between the flanges 51 and 52 and the long edges 66 and 68 of the web member 54, the bevels 53 and 56 cooperate with the interior surfaces 90 and 94 to form weld pockets 57 for the tack welds 13. The sections 17*b*, 17*c*, 17*d* are arranged in the remaining three sides of the openings and attached in the same manner as channel section 17*a*. The channel sections 17*a*, 17*b*, 17*c*, and 17*d* substantially circumscribe the openings 8 and 10.

Figure 5:
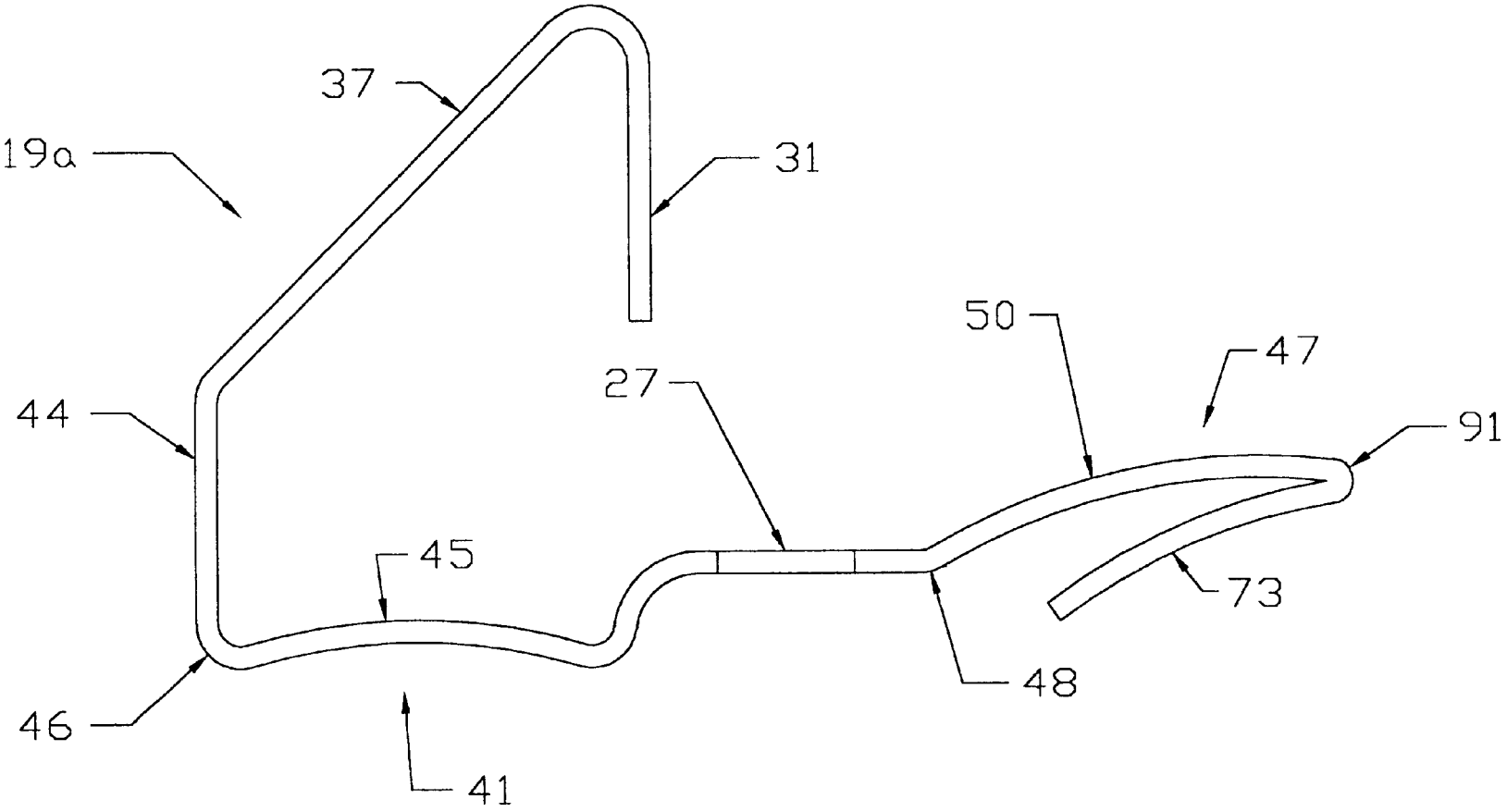
FIG. 5 is a cross-sectional view showing features of a preferred embodiment of the first frame sections of the present invention.

Referring to FIG. 5, the first frame section 19*a* includes a first leg 41, a second leg 44, an inclined member 37 and a stop member 31. The first leg 41 has two long edges 46 and 48. A plurality of openings 27 for receiving self-tapping screws 29 are positioned between the edges 46 and 48 of the first leg 41. The first leg 41 preferably has a curved segment 45 for resting on the curved segment 55 of the web member 54. The second leg 44 has a first long edge 95 and a second long edge 96. The first long edge 95 of the second leg 44 is joined to the long edge 46 of the first leg 41 to form a first frame section 19*a* having a generally L-shaped cross-section.

The inclined member 37 also has a first long edge 97 and a second long edge 98. The first long edge 97 of the inclined member 37 is joined to the second long edge 96 of the second leg 44. The inclined member 37 extends at an angle toward the centerline of the web member 54 so that the inclined member 37 is positioned directly above and spaced apart from the first leg 41.

The stop member 31 has a first long edge 99 and a second long edge 100. The first long edge 99 of the stop member 31 is joined to the second long edge 98 of the inclined member 37. The stop member 31 extends from the inclined member 37 in a direction which is substantially perpendicular to the first leg 41.

The first frame section 19*a* is secured to the channel section 17*a* along the front opening 8 by positioning the first leg 41 on the curved segment 55 of the channel section 17*a*. As shown in FIG. 3, the curved segment 55 of the web member 54 corresponds to the shape of the curved segment 45 of the first leg 41 so the first frame section 19*a* nests on the web member 54 of the channel section 17*a*. The openings 27 in the first leg 41 align with the guide groove 25 so that the first frame section 19*a* can be securely attached to the channel section 17*a* by inserting self-tapping screws 29 through the aligned openings 27. The first frame section 19*a* is oriented so the second leg 44 of the first frame section 19*a* preferably contacts, but does not protrude past, the interior surface 90 of the front door skin 7.

In a particularly preferred embodiment, the long edge 48 of the first leg 41 is configured to form a latch member 47 for retaining a clip member 75 formed at an edge 82 of the first leg 43 of the second frame section 21*a*. The latch member 47 is formed by folding a portion of the first leg 41 along a line parallel to the long edge 48 of the first frame section 17*a* to form a down-turned segment 73 which projects toward the web member 54 of the channel section 17*a*. The portion of the first leg 41 at the fold forms a bend 91 for resting against the second frame section 21*a*. The long edge 48 of the first leg 41 is positioned above the web member 54 to form a narrow space 101. The clip member 75 of the second frame section 21*a* is held in the narrow space 101 between the long edge 48 and the web member 54 is the second frame section 21*a* is securely fastened within the back opening 10.

First frame sections 19*b*, 19*c*, 19*d* are oriented in a similar manner around the front opening 8 to form the first frame 19 of the present invention. The inclined members 37 and the second legs 44 of the first frame sections form the visible portion of the first frame 19. Further, the stop members 31 cooperate to form a glass retaining surface (not shown) for installing a pane of glass 23.

Figure 6:
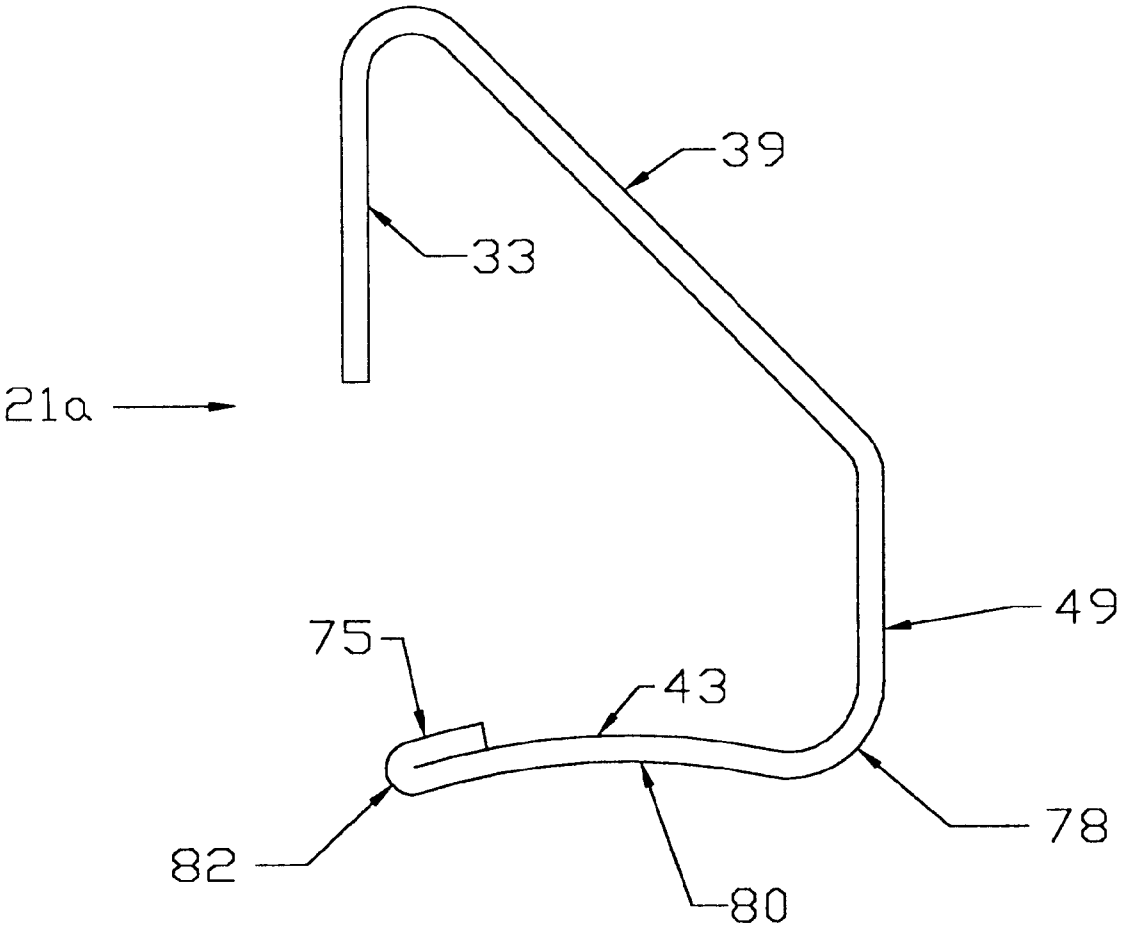
FIG. 6 is a cross-sectional view showing features of a preferred embodiment of the second frame sections of the present invention.

Referring to FIG. 6, the second frame section 21*a* is formed from a firs t leg 43, a second leg 49, an inclined member 39 and a stop member 33. The first leg 43 has two long edges 78 and 82 with a curved segment 80 disposed between the edges 78 and 82. The second leg 49 has a first long edge 102 and a second long edge 103. The first long edge 102 of the second leg 49 is joined to the long edge 78 of the first leg 43 to form a second frame section 21*a* having a generally L-shaped cross-section.

The inclined member 39 also has a first long edge 104 and a second long edge 105. The first long edge 104 of the inclined member 39 is joined to the second long edge 103 of the second leg 49. The inclined member 39 extends at an angle toward the centerline of the web member 54 so that the inclined member 39 is positioned directly above and spaced apart from the first leg 43. The stop member 33 has a first long edge 106 and a second long edge 107. The first long edge 106 of the stop member 33 is joined to the second long edge 105 of the inclined member 39. The stop member 33 extends from the inclined member 39 in a direction which is substantially perpendicular to the first leg 43.

The second frame section 21*a* is installed around the back opening 10 by positioning the first leg 43 of the second frame section 21*a* on the web member 54 of the channel section 17*a*. As shown in FIG. 3, the curved segment 58 of the web member 54 corresponds to the shape of the curved segment 80 of the first leg 43 so the second frame section 21*a* nests on the web member 54 of the channel section 17*a*. The second frame section 21*a* is oriented so the second leg 49 contacts, but does not extend beyond, the interior surface 94 of the back door skin 9.

Figure 11:
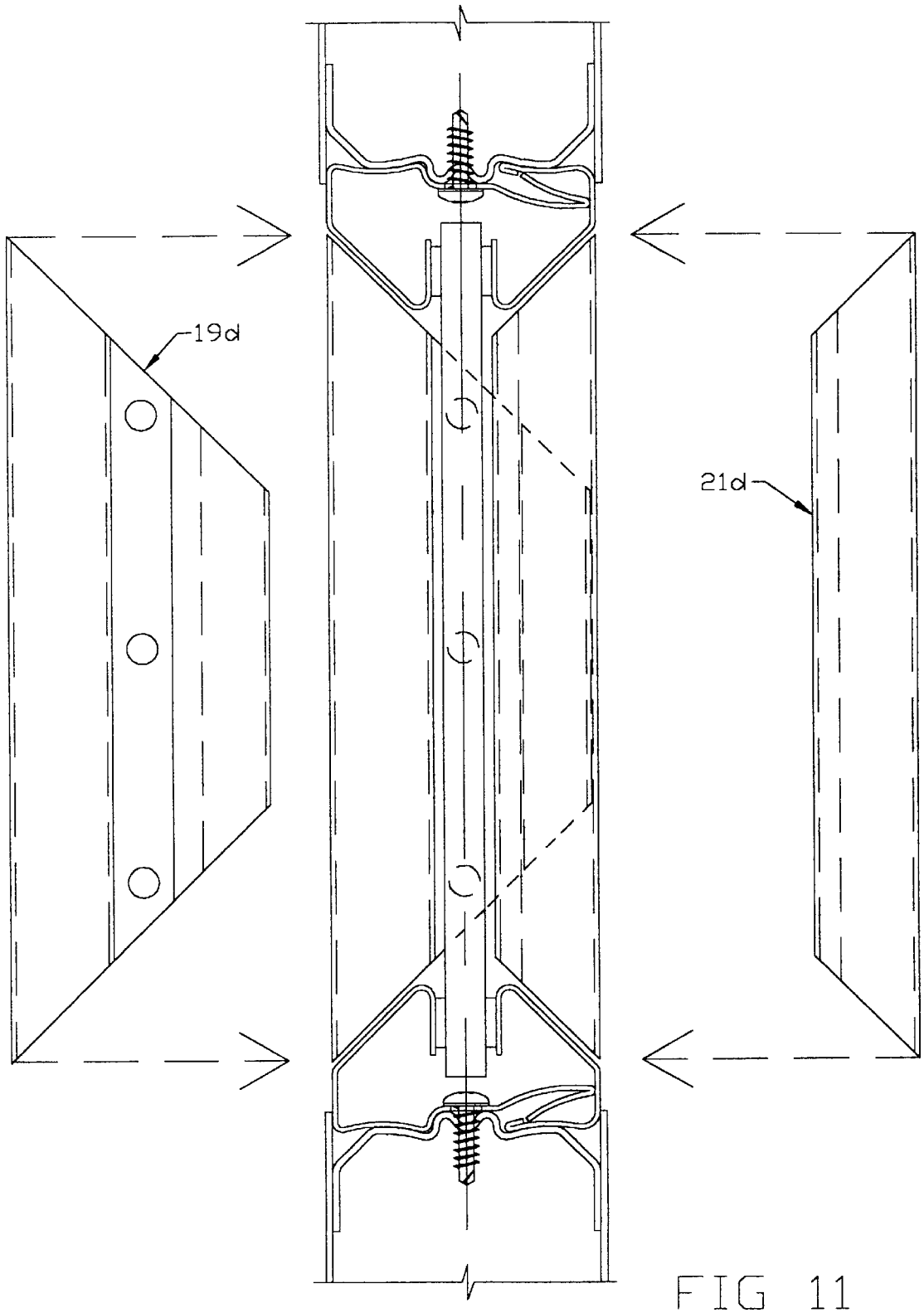
FIG. 11 is a side view showing typical installation procedures for the vertical sections of the first frame and second frame of the present invention.
Figure 12:
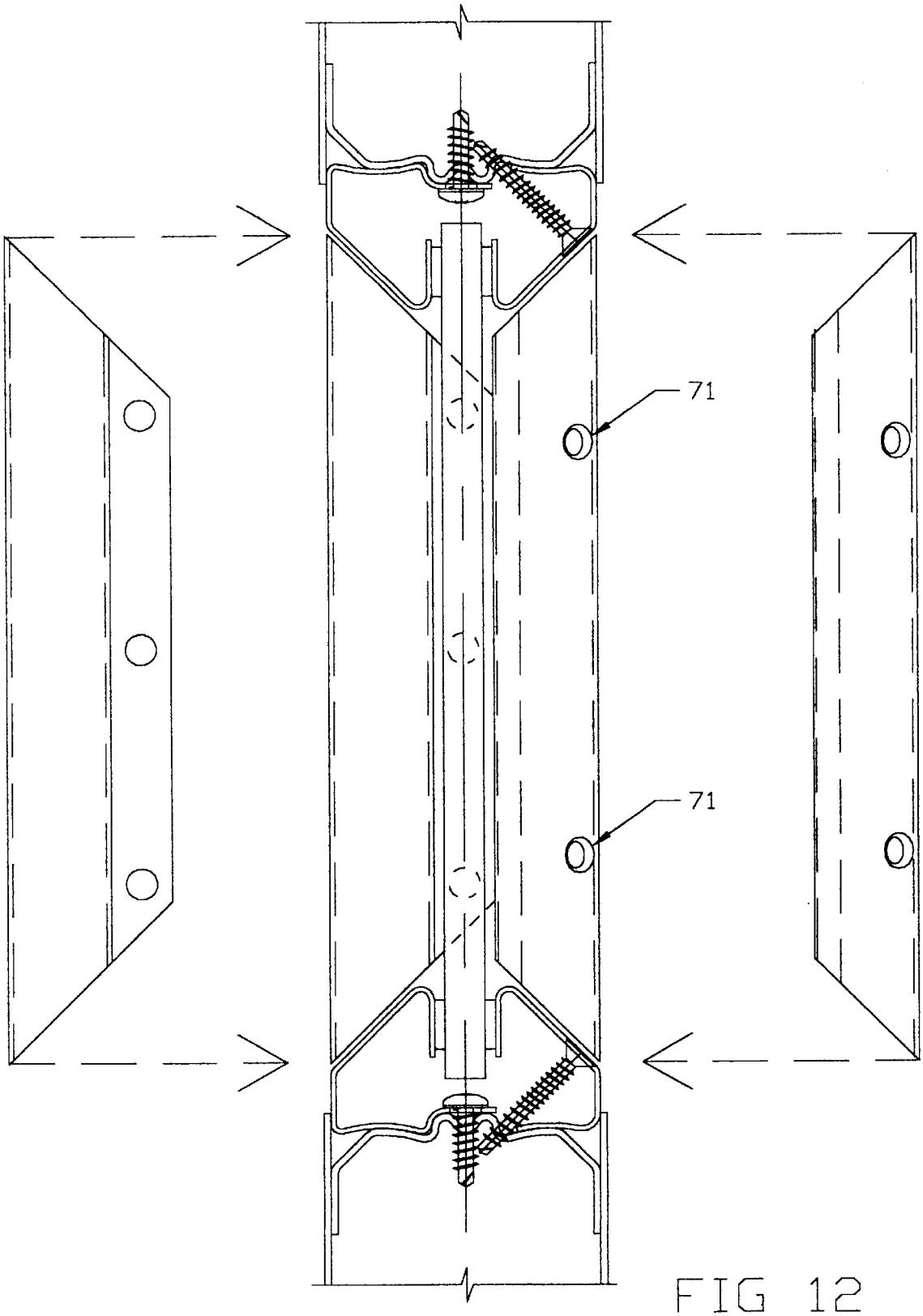
FIG. 12 is a side view showing features of a second embodiment of the present framing assembly.

Referring to FIG. 11, a plurality of openings 71 for receiving self-tapping screws 29 may be disposed in the inclined member 39. The screws 29 are inserted in the openings 71 and advanced through the guide groove 28 to attach the second frame section 21*a* to the channel section 17*a*. In this embodiment, the latch member 47 of the first frame section 19*a* is omitted because the latch member 47 conceals the guide groove 28. In a particularly preferred embodiment, the latch member 47 is provided along with a clip member 75. The clip member 75 is formed at the edge 82 of the first leg 43. The clip member 75 is preferably formed by a fold at the edge 82. However, any configuration will suffice that provides an enlarged segment at the edge 82.

The clip member 75 snaps securely in the space 101 formed by down-turned segment 73 of the latch member 47 and the web member 54. The second leg 49 of the second frame section 21*a* rests against the bend 91 of the first frame section 19*a*. The bend 91 assures a snug fit between the second leg 49 and the interior surface 94 and prevents the frame section 21*a* from moving.

Second frame sections 19*b, c, d* are oriented in a similar manner around the back opening 10 to form the second frame 19 of the present invention. The inclined members 39 and the second legs 49 of the second frame sections form the visible portion of the second frame 21. Further, the stop members 33 cooperate to form a second glass retaining surface (not shown). The first and second glass retaining surfaces secure a pane of glass 23 between the first 19 and second 21 frames.

Figure 8:
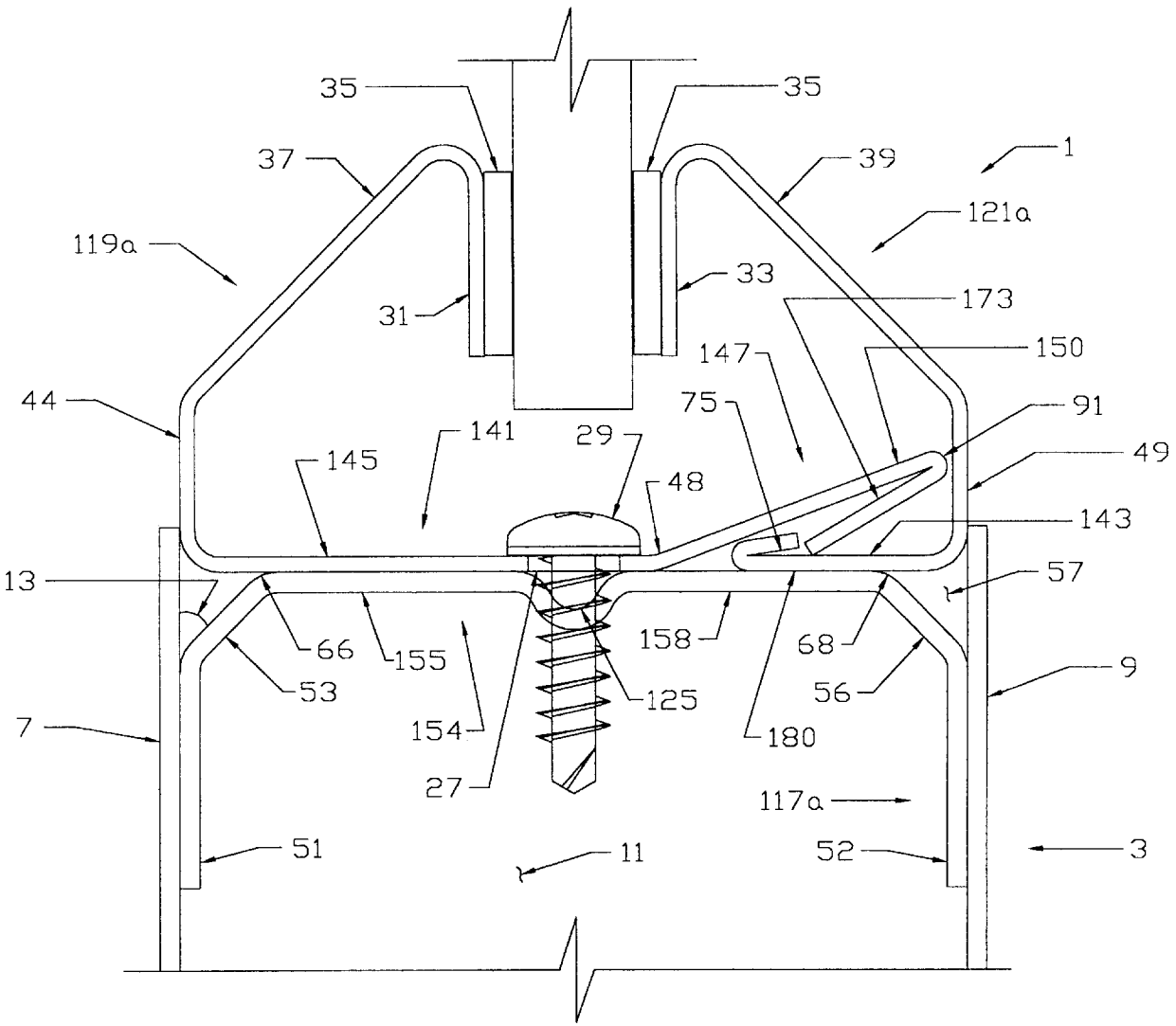
FIG. 8 is a cross-sectional view showing features of a first alternate embodiment of the channel sections, first frame, and second frame of the present invention.

A first alternate embodiment of the present framing assembly 1 is shown in FIG. 8. The elements of the first alternate embodiment generally correspond to those previously described. The changes reside primarily in the shape of the various features. For instance, a channel section 117*a* has a web member 154 with flat segments 155 and 158 in lieu of curved segments 55 and 58. A single guide groove 125 is defined by the web member 154 and preferably extends the length of the channel section 117*a*.

Similarly, a first frame section 119*a* has a first leg 141 having a substantially flat segment 145. A latch member 147 and a down-turned portion 173 are also both substantially flat. Finally, a second frame section 121*a* has a first leg 143 having a flat segment 180.

To install a preferred embodiment of the present framing assembly 1, the openings 8 and 10 are cut by a computer numerically controlled punch (not shown). Alternately, the openings 8 and 10 can be cut in the field by a hand-held reciprocating saw or similar tool (not shown). Any burrs or rough spots in the opening are removed with a grinder, rasp or similar tool. The door skins 7 and 9 do not require bending or further modification to install the present framing assembly 1.

Channel sections 17*a, b, c*, and *d* are cut to length according to the height and width of the openings. Next, each section is inserted in the hollow space 11 between the openings 8 and 10. The flanges 51 and 52 of each section are disposed between the front skin 7 and the back skin 9 and extend away from the opening 5. Welds 13 are placed in the weld pockets 57 to secure the channel sections to the front door skin 7 and back door skin 9.

Figure 9:
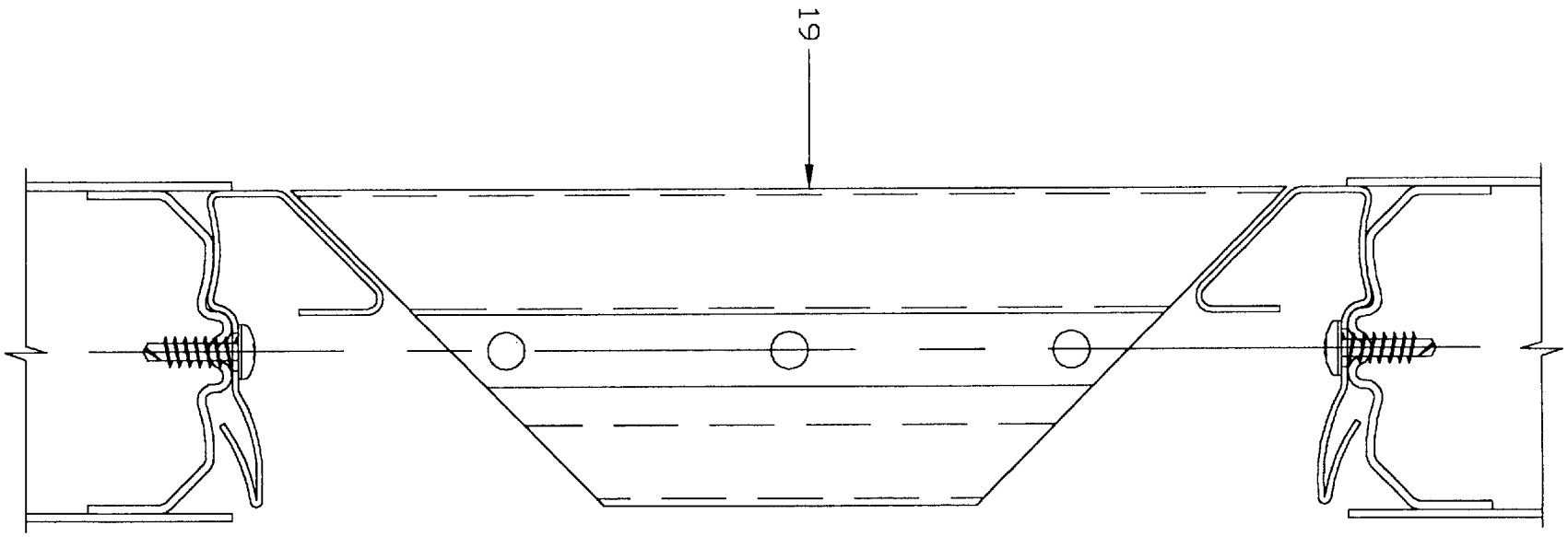
FIG. 9 is a side view of typical mitered ends of preferred embodiment of the first frame sections.
Figure 10:
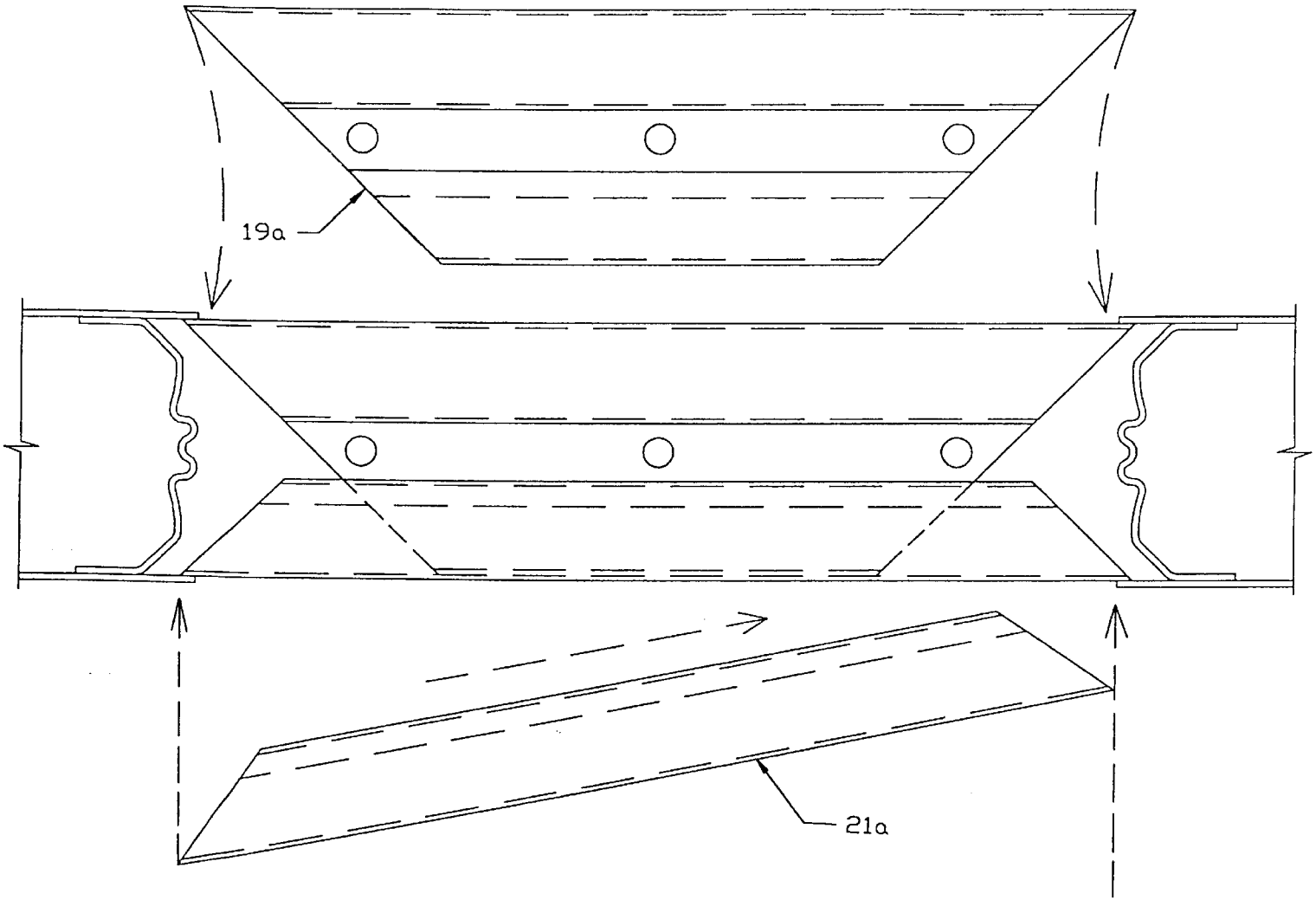
FIG. 10 is a top view showing typical installation procedures for the horizontal sections of the first frame and second frame of the present invention.

Next, the first frame sections 19*a, b, c, d* are cut into four sections according to the height and width of the openings 8 and 10 and mitered at the ends as shown in FIG. 9. Generally, the first frame sections 19*a, b, c, d* are inserted around the front opening 8. Preferably, the two sections of first frame 19 that form the vertical components and are cut shorter than the height of the front opening 8. The horizontal components of first frame 19 are cut longer than the width of the front opening 8. Referring to FIG. 10, the horizontal sections are installed first. The ends of the horizontal sections slip behind the front door skin 7 and contact the interior surface 90.

Referring to FIG. 11, the vertical sections are installed next. The ends of the vertical sections do not slip behind the front door skin 7 since the sections are shorter than the height of the front opening 8. However, the ends of the vertical sections extend over the horizontal sections to provide a mitered appearance at the corners. Each section of the first frame 19 is attached to the channel 17 by inserting the self tapping screws 29 through the openings 27 and threading the screws 29 through the guide groove 25 of the channel sections.

The pane of glass 23 is installed between the first frame 19 and the second frame 21. As is well known in the art, a gasket or adhesive 35 or any other type of similar glass installation apparatus may be used to secure the pane of glass.

Next, the second frame sections 21*a, b, c, d* are cut to length and mitered at the ends as shown in FIG. 10. Preferably, the two sections of second frame 21 that form the vertical frame are cut shorter than the height of the back opening 10. The horizontal sections of the second frame 21 are cut longer than the width of the back opening 10. Using the preferred lengths of second frame sections, the horizontal sections are installed first. The ends slip behind the back door skin 9 and contact the interior surface 94. Referring to FIG. 11, the vertical sections are installed next. The ends of the vertical sections do not slip behind the back door skin 9 since the sections are shorter in length than the height of the back opening 10. However, the ends of the vertical sections extend over the horizontal sections to provide a mitered appearance at the corners.

Preferably, each section of the second frame 21 is installed by pushing the clip member 75 of each second frame section between the catch 47 and the web member 54 of each first frame section until the second frame sections snap into place around the back opening 10. Alternately, self-tapping screws 29 are inserted through the openings 71 in the second frame 21 and tapped through the guide groove 28 of the channel 17.

Alternately, the channel 17 is installed in the hollow space 11 so the web member 54 is substantially even with the perimeter of the front 8 and back 10 opening. When the first and second frames 19 and 21 are cut and installed, they are positioned on the web member 54 of the channel sections so the second legs 41 and 43 do not contact the interior surfaces 90 and 94 of the door skins 7 and 9. Rather, the second legs 41 and 43 are flush with the exterior surfaces 92 and 96 of the door skins 7 and 9. If the present framing assembly 1 is installed in an exterior door, caulk or a similar sealant may be applied at all exposed joints and mating surfaces to prevent moisture from entering the door.

The present framing assembly 1 allows panic hardware to be installed without shims or other modification to the door or panic hardware. Further, the frames 19 and 21 of the present framing assembly 1 does not protrude past the face of the door to cause problems with compliance with handicap codes.

Figure 13:
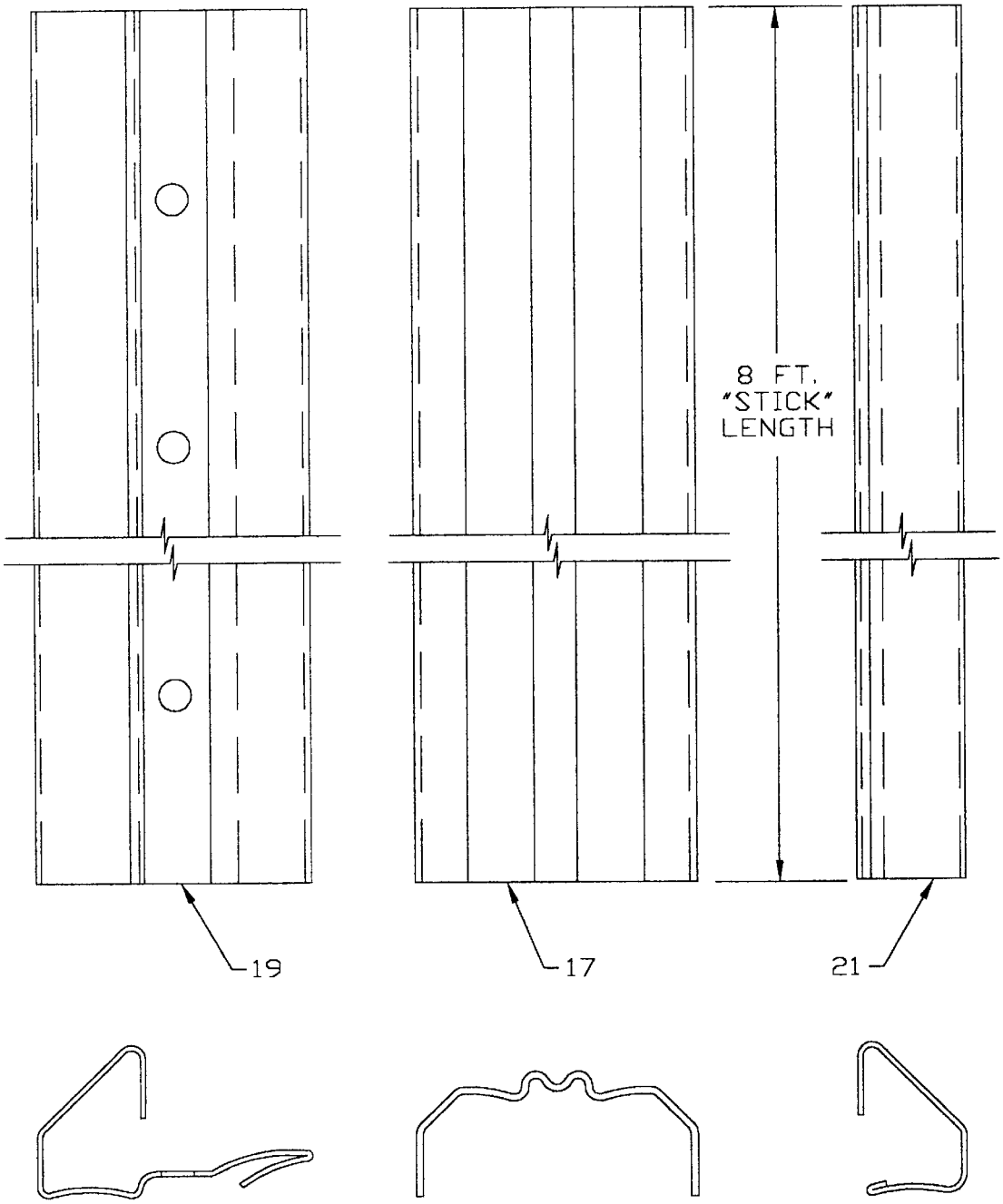
FIG. 13 is a top view and end view showing features of the channel sections, first frame and second frame of the present invention.

Although FIGS. 1–13 illustrate a frame having four sides, the framing assembly of the present invention may be installed in openings having three or more sides or in openings having circular or curved perimeters. The channel sections, first frame 19, and second frame 21 of the present invention may fabricated to a variety of lengths. In a preferred embodiment, the components are roll-formed from a single sheet of metal and fabricated in eight to twelve foot lengths as shown in FIG. 13. The channel sections, first frame 19 and second frame 21 may further be provided in a variety of widths to fit in a hollow door of any width. As the foregoing illustrates, the visible portions of the frames of the present framing assembly require no welding. Therefore, particularly preferred materials include stainless steel, polished or antiqued brass, or similar metals that can receive a pre-finished surface.

The present invention is not limited to doors, but can be installed in any hollow panel having a front and back door skin. While the present invention has been described with reference to the accompanying drawings, it is understood that various modifications or alterations may be made to the described embodiments. Therefore, the scope of the present invention is defined by the following claims.

What is claimed is:

1. A framing assembly for mounting a door light in an opening in a panel having a front skin spaced apart from a back skin to define a hollow space between the skins, each of the skins having an exterior surface and an interior surface and an opening having a perimeter, said framing assembly comprising:

at least one channel section having a web member, said channel section being configured to be positioned within the space between the skins so that said web member spans between the interior surfaces of the front and back skins and is recessed from the perimeters of the openings in the front and back skins, wherein said web member of said channel section defines at least one guide groove for receiving fasteners;

at least one first frame section having a first leg and a second leg, said second leg being substantially perpendicular to said first leg, said first frame section being attached to said channel section so that the second leg is positioned within the perimeter of the opening in the front skin, said first frame section further including a latch member; and at least one second frame section having a first leg and a second leg, said second leg of said second frame section being substantially perpendicular to said first leg of said second frame, said second frame section further including a clip member which cooperates with said latch member to retain said second frame section within the perimeter of the opening in the back skin.

2. The framing assembly as defined in claim 1 wherein the first leg of the first frame section is provided with a plurality of openings which align with said guide groove.

3. The framing assembly as defined in claim 1, wherein said first frame section and said second frame section are each provided with stop members which cooperate to form glass retaining surfaces for retaining a pane of glass.

4. A framing assembly for mounting a door light in an opening in a panel having a front skin spaced apart from a back skin to define a hollow space between the skins, each of the skins having an exterior surface and an interior surface and an opening having a perimeter, said framing assembly comprising:

at least one channel section having a web member, said channel section being configured to be positioned within the space between the skins so that said web member spans between the interior surfaces of the front and back skins and is recessed from the perimeters of the openings in the front and back skins, wherein said web member of said channel section further includes at least one bevel to form a welding pocket between said bevel and said interior surface of at least one of said front skin and said back skin;

at least one first frame section having a first leg and a second leg, said second leg being substantially perpendicular to said first leg, said first frame section being attached to said channel section so that the second leg is positioned within the perimeter of the opening in the front skin, said first frame section further including a latch member; and at least one second frame section having a first leg and a second leg, said second leg of said second frame section being substantially perpendicular to said first leg of said second frame, said second frame section further including a clip member which cooperates with said latch member to retain said second frame section within the perimeter of the opening in the back skin.

5. The framing assembly as defined in claim 4 wherein said first frame section and said second frame section are each provided with stop members which cooperate to form glass retaining surfaces for retaining a pane of glass.

6. The framing assembly as defined in claim 4 wherein said web member of said channel section defines at least one guide groove for receiving fasteners.

7. The framing assembly as defined in claim 6 wherein the first leg of the first frame section is provided with a plurality of openings which align with said guide groove.

8. The framing assembly as defined in claim 4 wherein said first frame section is attached to said channel section so that said second leg of said first frame section contacts the interior surface of said front skin when said second leg is positioned within the perimeter of the opening in the front skin.

9. The framing assembly as defined in claim 4 wherein said second frame section is positioned on said channel section so that the second leg of the second frame section contacts the interior surface of the back skin when the second leg is positioned within the perimeter of the opening in the back skin.

10. The framing assembly as defined in claim 4 wherein said first frame section is made of a metal selected from the group consisting of stainless steel, polished brass and antiqued brass, said metal having a prefinished surface.

11. The framing assembly as defined in claim 4 wherein said second frame section is made of a metal selected from the group consisting of stainless steel, polished brass and antiqued brass, said metal having a prefinished surface.

12. A framing assembly for mounting a door light in an opening in a panel having a front skin spaced apart from a back skin to define a hollow space between the skins, each of the skins having an exterior surface and an interior surface an opening having a perimeter, said framing assembly comprising:

at least one channel section having a web member, said channel section being configured to be positioned within the space between the skins so that said web member spans between the interior surfaces of the front and back skins and is recessed from the perimeters of the openings in the front and back skins, said web member of said channel section defining at least two guide grooves for receiving fasteners;

at least one first frame section having a first leg and a second leg, s aid second leg being substantially perpendicular to said first leg, said first frame section being attached to said channel section so that the second leg is positioned within the perimeter of the opening in the front skin; and at least one second frame section having a first leg and a second leg, said second leg of said second frame section being substantially perpendicular to said first leg of said second frame, said second frame section further having an inclined member extending from said second leg of the second frame section, said inclined member defining a plurality of openings for receiving fasteners;

wherein said second frame section is attached to said channel section by inserting fasteners through said plurality of openings and threading said fasteners through one of said guide grooves.

13. The framing assembly as defined in claim 12, wherein:

said first leg of said first frame section is provided with a plurality of openings which align with a second one of said guide grooves;

said first frame section is attached to said channel section by inserting fasteners through said plurality of openings in said first frame section and threading said fasteners through said second one of said guide grooves.

14. A framing assembly for mounting a door light in an opening in a panel having a front skin spaced apart from a back skin to define a hollow space between the skins, each of the skins having an exterior surface and an interior surface and an opening having a perimeter, said framing assembly comprising:

at least one channel section having a web member, said channel section being configured to be positioned within the space between the skins so that said web member spans between the interior surfaces of the front and back skins and is recessed from the perimeters of the openings in the front and back skins, wherein said web member of said channel section further includes at least one bevel to form a welding pocket between said bevel and said interior surface of at least one of said front skin and said back skin;

at least one first frame section having a first leg and a second leg, said second leg extending from said first leg, said first frame section being attached to said channel section so that said second leg is positioned within the perimeter of the opening in the front skin, said first frame section further including a latch member; and at least one second frame section having a first leg and a second leg, said second leg of said second frame section extending from said first leg of said second frame section, said second frame section further including a clip member which cooperates with said latch member to retain said second frame section within the perimeter of the opening in the back skin.

15. A framing assembly for mounting a door light in an opening in a panel having a front skin spaced apart from a back skin to define a hollow space between the skins, each of the skins having an exterior surface and an interior surface and an opening having a perimeter, said framing assembly comprising:

at least one channel section having a web member, said channel section being configured to be positioned within the space between the skins so that said web member spans between the interior surfaces of the front and back skins and is recessed from the perimeters of the openings in the front and back skins;

at least one first frame section having a first leg and a second leg, said second leg extending from said first leg, said first frame section being attached to said channel section so that said second leg is positioned within the perimeter of the opening in the front skin, said first frame section further including a latch member and a bend, said latch member and said bend being formed by folding a portion of said first leg of said first frame section; and at least one second frame section having a first leg and a second leg, said second leg of said second frame section extending from said first leg of said second frame section, said second frame section further including a clip member which cooperates with said latch member to retain said second frame section within the perimeter of the opening in the back skin; wherein said bend of said first frame section is disposed against said second leg of said second frame section thereby assuring a snug fit between said second leg of said second frame section and the interior surface of the back skin whereby said second frame section is further retained within the perimeter of the opening in the back skin;

said web member of said channel section further includes at least one bevel to form a welding pocket between said bevel and the interior surface of at least one of the front and back skins of the panel.

* * * * *